United States Patent [19]

Pasbrig

[11] 4,368,728

[45] Jan. 18, 1983

[54] APPLIANCE FOR TRAINING FINGER JOINTS

[75] Inventor: Max Pasbrig, Orselina, Switzerland

[73] Assignee: Lacrex Brevetti S.A., Orselina, Switzerland

[21] Appl. No.: 205,984

[22] Filed: Nov. 12, 1980

[51] Int. Cl.[3] ..... A61H 1/00

[52] U.S. Cl. ..... 128/26

[58] Field of Search ..... 272/67; 128/26, 77, 128/78

[56] References Cited

U.S. PATENT DOCUMENTS

| | | | |
|---|---|---|---|
| 1,290,742 | 1/1919 | Hermansen | 128/26 |
| 1,833,357 | 11/1931 | Enzler | 128/26 |
| 3,216,412 | 11/1965 | Houle | 128/26 |

FOREIGN PATENT DOCUMENTS

| | | | |
|---|---|---|---|
| 2017645 | 5/1976 | Fed. Rep. of Germany | 128/26 |
| 486552 | 4/1918 | France | 128/26 |

*Primary Examiner*—Richard J. Apley
*Assistant Examiner*—Carl Moy
*Attorney, Agent, or Firm*—Fleit & Jacobson

[57] ABSTRACT

A plurality of guides are mounted in a housing. Each of the guides is movable up and down transversely to its longitudinal direction. A plurality of sleeve carriers are slidably mounted on respective ones of the guides. A plurality of finger sleeves extend on top of the housing and are secured to respective ones of the sleeve carriers. A drive is provided for reciprocating the guides up and down with the sleeve carriers and finger sleeves and for reciprocating the sleeve carriers with the finger sleeves along said guides. A horizontal shaft is mounted in the housing for rotation on a first axis. The drive comprises a motor for rotating the shaft. A plurality of eccentric camwheels are non-rotatably mounted on the shaft. A plurality of levers are pivoted in the housing on a common second axis, which is parallel to the first axis. Each of the levers has a forward end portion, which is spaced from the second axis and constitutes one of the guides and is formed with a longitudinal groove, which receives one of the sleeve carriers. Each of the levers rides on the periphery of one of the camwheels between the groove and the second axis.

5 Claims, 4 Drawing Figures

APPLIANCE FOR TRAINING FINGER JOINTS

Figure 1:
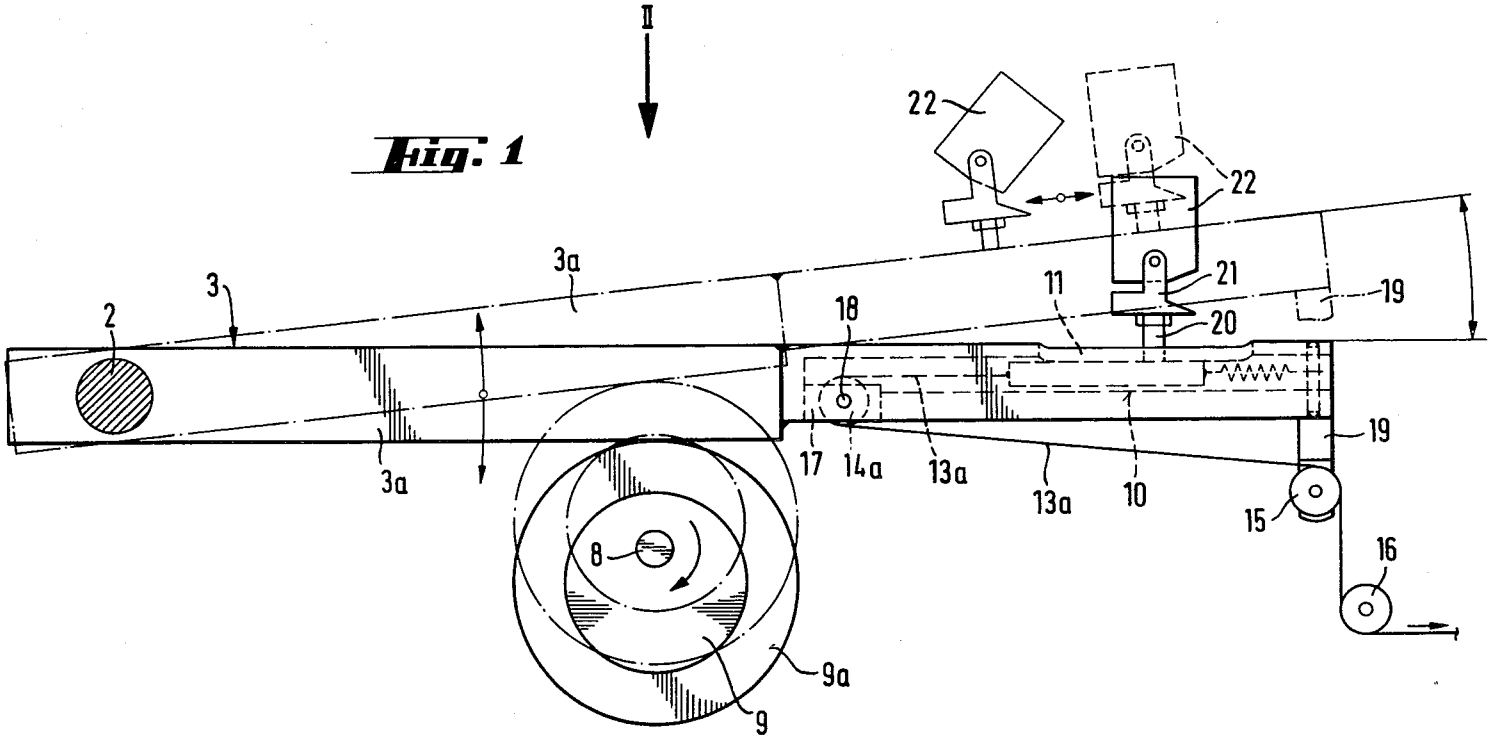

This invention relates to an appliance for training finger joints, comprising a housing and a plurality of finger sleeves, which are disposed on top of the housing and intended to receive the foremost segments of the fingers and secured to carriers, which are longitudinally slidable in guides and drive means for vertically reciprocating said sleeves with the guides and for horizontally reciprocating the carriers in the guides.

German Patent specification No. 2,017,645 discloses an appliance of this kind which has proved satisfactory in practice. In that known appliance the guides consist of slide rails and are secured to push rods, which are moved up and down by eccentrics, which are secured to a common drive shaft mounted in the housing.

It is an object of the present invention to simplify the drive means for vertically and horizontally reciprocating the finger sleeves in the known appliance.

This object is accomplished according to the invention in that the guides consist of axially extending grooves formed at the forward ends of pivoted levers, that portion of each lever which is disposed between the common pivotal axis of the levers and the groove rides on the peripheral surface of an eccentric camwheel, and said camwheels are secured to a motor-driven shaft which is parallel to the pivotal axis of the levers. This invention provides a particularly advantageous improvement of the appliance disclosed in German Patent specification No. 2,017,645. The novel appliance is simpler than the known one because the guides are no longer secured to push rods which are vertically reciprocated by eccentric camwheels but the guides consist of parts of levers which are moved by the camwheels. Because the push rods have been replaced by pivoted levers, the more expensive means for guiding the plungers can be omitted.

Each guide consists suitably of an axial bore of the lever and each lever is provided on its top with a longitudinal slot, which opens into the bore in an intermediate portion of its length.

According to a preferred further feature of the innovation, pins which constitute the carriers are axially slidably mounted in the bore and studs are secured to the pins and extend transversely from them through the slots and carry the finger sleeves. The bore contains a tension spring having a forward end portion secured to the lever near its forward end and a rear end portion secured to the forward end face of the pin. A rope is provided, which is secured at one end to the rear end of the pin and is trained around a first pulley, which is mounted in a slot that opens into the rear lower portion of the bore, and around a second pulley, which is mounted in a pulley carrier that is secured to the lever at its forward end. The other end of the rope is secured to a housing wall. When the levers move up and down in response to the rotation of the eccentric camwheels, the carriers which carry the finger sleeves will reciprocate in the slots because tensile forces for reciprocating the carriers are exerted through the intermediary of the rope in one direction and through the intermediary of the tension spring in the opposite direction in step with the up and down motion of the levers.

There are suitably five levers, which have parallel rear end portions whereas the forward end portions of the levers, except for the straight middle one, are angled to form a fanlike array. Depending on whether the left or right hand is to be treated, the left or right outer finger sleeve is left free.

The fingers will be worked through particularly thoroughly if the eccentric camwheels are secured to their shafts in different rotational positions so that the up and down movements of the levers will be displaced in phase.

In the appliance according to the invention, the fingers are held in the finger sleeve with their foremost segments and are flexed and stretched. This results in a good kinetotherapeutic training, by which the mobility of the fingers can be restored after injuries or the like.

Figure 2:
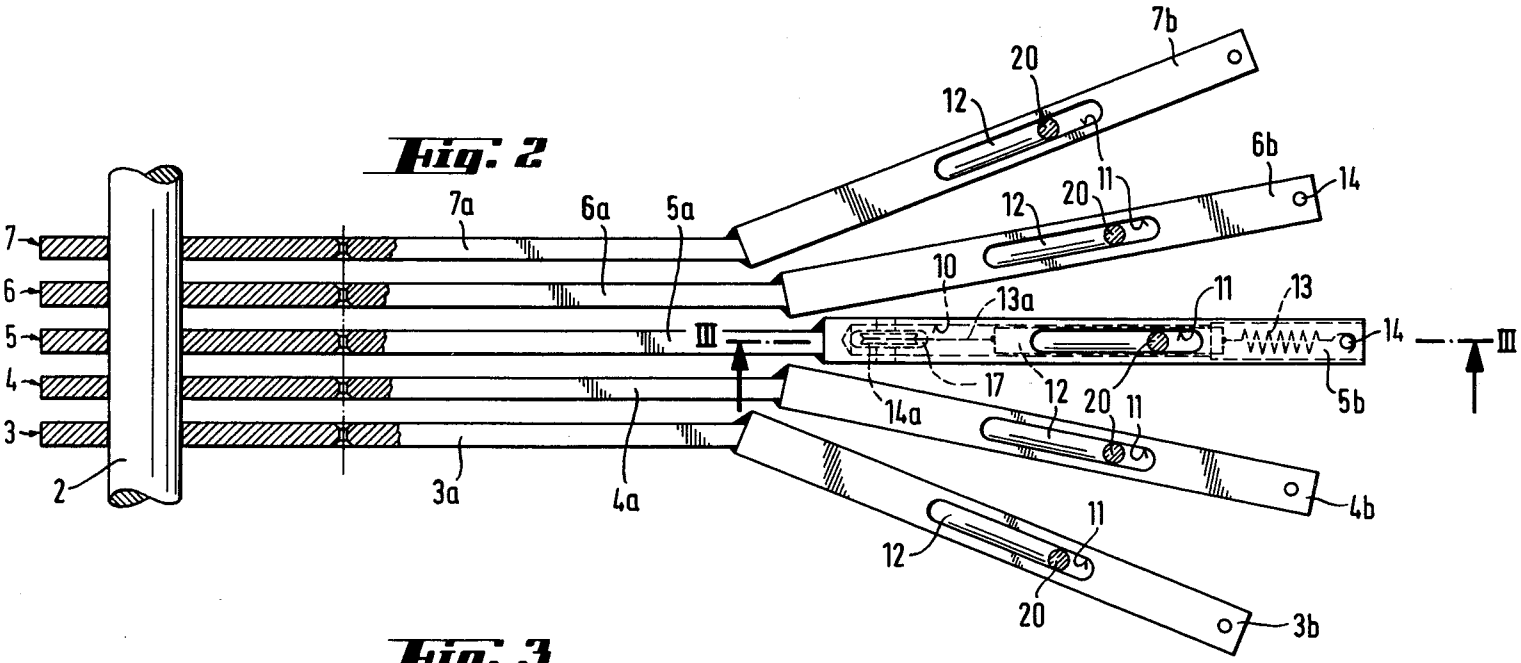
Figure 3:
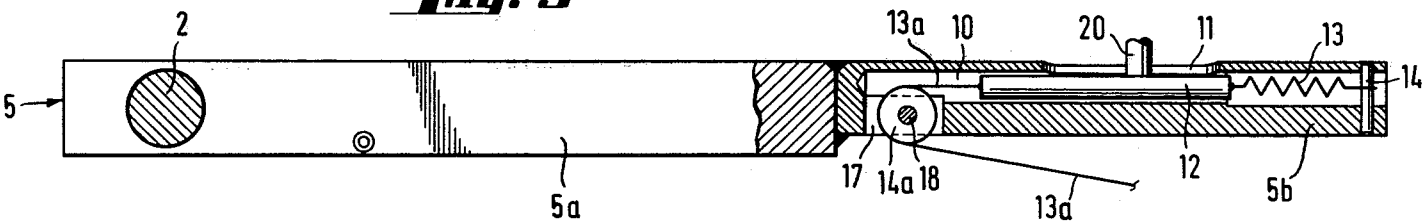
Figure 4:
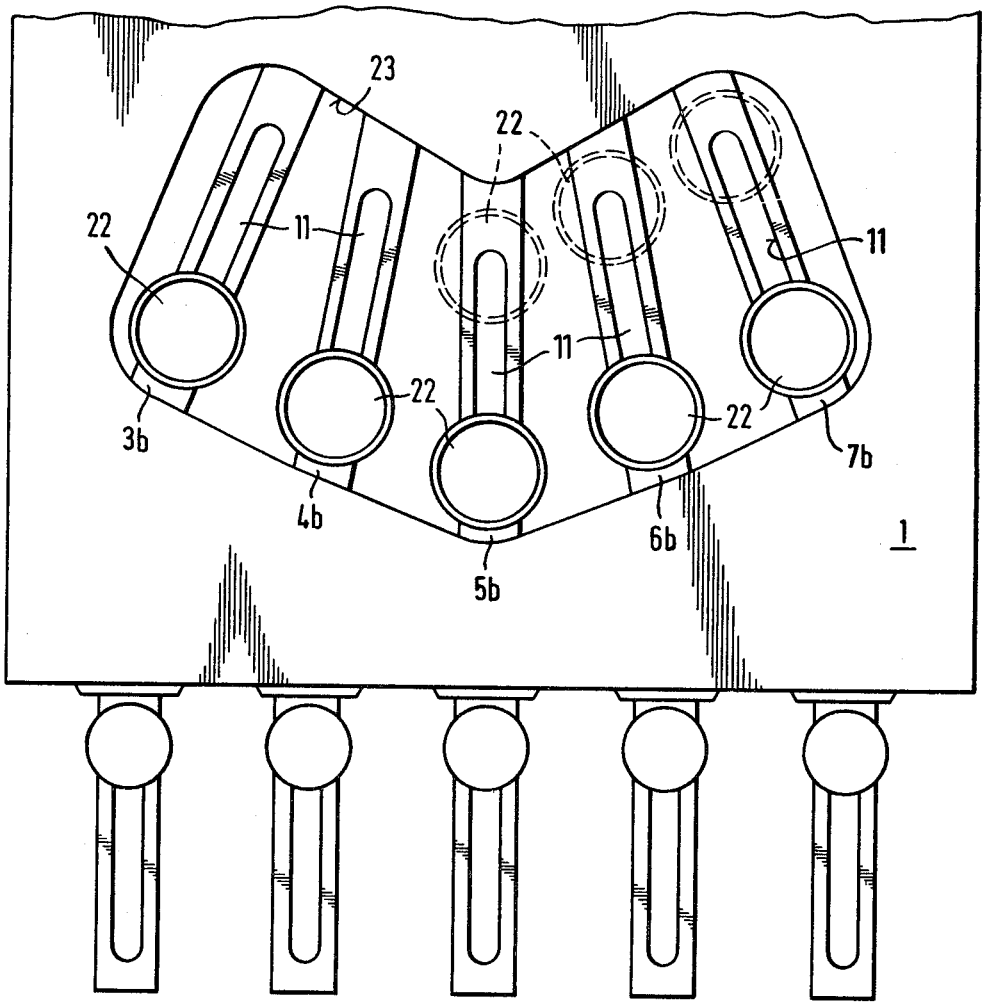

An illustrative embodiment of the invention will now be described more fully with reference to the drawing, in which FIG. 1 is a side elevation showing the pivoted levers, which have longitudinal guides carrying the finger sleeves and are moved by eccentric camwheels, FIG. 2 is a top plan view of the pivoted levers, with guides, FIG. 3 is a longitudinal sectional view showing the middle lever of FIG. 2, and FIG. 4 is a top plan view showing that portion of the housing which contains the finger sleeves, which are longitudinally slidably mounted in the guides.

The levers 3 to 7 are pivoted on the pivot 2, which is mounted in the housing 1. The levers have parallel rear portions and have forward portions which carry the guides and constitute a fanlike array. A shaft 8 which is parallel to the pivot 2 and driven by a motor, not shown, is mounted in the housing 1. The levers 3 to 7 ride on five camwheels 9, which are secured to the shaft 8. The camwheels 9 are secured to the shaft 8 in different rotational positions so that the up and down movements performed by the levers are displaced in phase.

The forward portion of each of the levers 3 to 7 is formed with a bore 10. Each lever is also formed with a longitudinal slot 11, which opens into the bore 10 in the intermediate portion of its length. Pins 12 are axially slidably mounted in the bores 10. A tension spring 13 is secured at one end to the forward end of each pin and has another end that is secured to a stud 14*a*, which is secured in a transverse bore, which extends through the bore 10. A rope 13 is secured at one end to the forward end of each pin 12. The other end of each rope is secured to the housing by means which are not shown. The rope is trained around pulleys 14, 15, 16. Each pulley 14 is mounted for rotation about the axis 18 in a slot 17, which is provided on the underside of the associated lever and opens into the rear portion of the bore 10. Each pulley 15 is rotatably mounted in a forked carrier 19, which is secured to the forward end portion of the associated lever 3 to 7.

A stud 20 is secured to each pin 12 and extends laterally therefrom through the slot 11 and at its top end carries a forked carrier 21, in which the associated finger sleeve 22 is pivoted.

The levers 3 to 7 and the drive means for pivotally moving said levers are accommodated in the housing 1, which has a V-shaped cutout 23, in which the finger sleeves 22 are disposed.

What is claimed is:

1. In an appliance for training finger joints, comprising:

a housing, a plurality of guides mounted in said housing and each of which is movable up and down transversely to its longitudinal direction, a plurality of sleeve carriers slidably mounted on respective ones of said guides, a plurality of finger sleeves, which extend on top of said housing and are secured to respective ones of said sleeve carriers, and drive means for reciprocating said guides up and down with said sleeve carriers and finger sleeves and for reciprocating said sleeve carriers with said finger sleeves along said guides, the improvement comprising:

a shaft mounted in said housing for rotation about a first axis, said drive means comprising a motor for rotating said shaft, a plurality of eccentric cam wheels non-rotatably mounted on said shaft, a plurality of levers pivoted in said housing on a common second axis parallel to and spaced rearwardly from said first axis, each of said levers having a forward portion spaced forwardly from said first axis and constituting one of said guides and formed with a longitudinal groove, which receives one of said sleeve carriers, and each of said levers riding directly on the periphery of one of said cam wheels at a location spaced between said groove and said second axis, the forward portion of each of said levers being formed with a longitudinal bore, each of said levers having a top face formed with a longitudinal slot, which opens into said bore in an intermediate portion of its length to form said groove together with said intermediate portion, each of said sleeve carriers consisting of a pin, which is longitudinally slidably mounted in one of said bores in said intermediate portion thereof, a stud secured to each of said pins and extending laterally therefrom through the adjacent one of said slots and carrying one of said finger sleeves, each of said bores containing a tension spring, which has a forward end secured to the lever near its forward end and a rear end portion secured to the forward end of the associated pin, a plurality of ropes, each of which is secured at one end to the rear end of one of said pins, the other end of each of said ropes being secured to said housing, each of said ropes being trained around first and second pulleys, each of said levers being formed with a slot that opens into a rear lower portion of said bore, each of said first pulleys being mounted in one of said slots, a pulley carrier secured to each of said levers at its forward end, and each of said second pulleys being mounted in one of said pulley carriers.

2. The improvement set forth in claim 1, wherein said eccentric camwheels are secured on said shaft in different rotational positions.

3. The improvement set forth in claim 1, wherein a plurality of said levers are provided and have parallel rear end portions, an intermediate one of said levers is straight, and the forward end portions of said levers are angled relative to each other to form a fanlike array.

4. The improvement set forth in claim 3 wherein five levers are provided.

5. The improvement set forth in claim 3 or 4, wherein said cam wheels are positioned to contact the parallel rear end portions of said levers.

* * * * *